United States Patent [19]

Lehman

[11] Patent Number: 4,901,846

[45] Date of Patent: Feb. 20, 1990

[54] ARTIST'S PAINT CARRIER SYSTEM

[76] Inventor: Charles W. Lehman, 608 Hawkeye La., Kentland, Ind. 47951

[21] Appl. No.: 398,624

[22] Filed: Aug. 25, 1989

[51] Int. Cl.[4] ..... B05C 17/00

[52] U.S. Cl. ..... 206/1.8; 206/575; 206/501; 206/821

[58] Field of Search ..... 206/1.8, 1.7, 1.9, 216, 206/575, 501, 821

[56] References Cited

U.S. PATENT DOCUMENTS

| | | | |
|---|---|---|---|
| 1,710,679 | 4/1929 | Pels . | |
| 2,107,239 | 2/1938 | Eckhoff | 206/1.8 |
| 2,511,537 | 6/1950 | Migdow . | |
| 2,565,912 | 8/1951 | Davis . | |
| 2,741,048 | 4/1956 | Shelton | 206/1.8 |
| 2,756,530 | 7/1956 | Nelson | 206/1.8 |
| 3,023,884 | 3/1962 | Schwartz . | |
| 3,139,208 | 6/1964 | Irwin et al. | 206/1.8 |
| 3,359,228 | 12/1967 | Nichols . | |
| 3,426,888 | 2/1969 | Meth | 206/1.8 |
| 3,949,876 | 4/1976 | Bridges et al. . | |
| 3,983,993 | 10/1976 | Hsu . | |
| 4,311,237 | 1/1982 | Hayes . | |

*Primary Examiner*—Joseph Man-Fu Moy
*Attorney, Agent, or Firm*—Richard G. Kinney

[57] ABSTRACT

A lightweight paint carrier system for use with artist's acrylic paint containers or bottles of a fixed size and cylindrical shape. A number of generally circular trays are provided with a central post. The trays nest together with one tray nesting atop another to form either a single layer assembly or two or three layer assembly. The trays of the second and higher layers mount onto the post of the tray below and are supported therefrom in a cantilever fashion. The trays are of two types—a base which includes an artist's water basin surrounded by twelve wells for receiving the bottom of the bottles and an intermediate layer tray which has wells uniformly distributed on its upper surface for receiving eighteen of the paint containers. A top is provided for either the one base tray or the stack of nested trays and a handle having a rod of a length sized to accommodate a single tray stack or a multiple stack array is provided. The handle's rod has spring biased means for being manually and easily releasably latched to the base tray and is sized so as to secure together for transport and storage the top and the base tray together with any intermediate stacked trays. The system when stacked and latched holds paint containers seated in the wells by "sandwiching" them between adjacent trays or between a tray and the top.

9 Claims, 5 Drawing Sheets

ARTIST'S PAINT CARRIER SYSTEM

FIELD OF THE INVENTION

The present invention is directed to a new and improved artist's paint carrier system.

BACKGROUND OF THE INVENTION

Artists who work in acrylic paints commonly buy and use such paints in plastic containers or bottles. This contrasts, of course, with artists who work in oil based paints who conventionally buy and use squeeze tube containers for their paint. The acrylic paint bottles of different colors are standardized as to size and shape. An acrylic painter would normally use a dozen or more plastic bottles of different colored paints when painting a picture.

In the past, various container or case systems have been proposed for carrying containers of artist's paints. See, for example, Davis, U.S. Pat. No. 2,565,912; Hsu, U.S. Pat. No. 3,983,993; Nichols, U.S. Pat. No. 3,359,228; Schwartz, U.S. Pat. No. 3,023,884; Eckhoff, U.S. Pat. No. 2,107,239; and Pels, U.S. Pat. No. 1,710,679. And others have suggested palette releasable water basin arrangements (Migdow, U.S. Pat. No. 2,511,537).

There exists a need for a carrier system which can safely hold and carry the dozen-plus bottles of acrylic paints for transport and yet is easily "opened" to allow easy access and use of the bottles by the artists.

SUMMARY OF THE INVENTION

To meet this need, the present invention provides a system including at least one tray which defines a number of shallow wells or depressions sized to loosely receive the bottom portion of the standard paint bottle or container. Also provided are means for mounting a top or intermediate tray over the one tray such that the bottoms of the bottles are at or just below that bottom and are thus held in the wells from tipping over or falling out of the assembly. Further provided is means for releasably manually latching together the top and tray in that position. All of this to the end that the tray may be loaded with standard paint bottles, which may thereafter be secured for storage and travel but be readily available by manually unlatching and removing the top or upper tray.

In accordance with one feature of the invention is the making of at least the wells' upper surface of pure white color such that they may serve as paint mixing wells in addition to serving to secure paint bottles for storage or transport.

In accordance with a further feature of the invention, a water basin is provided as part of the bottom or base tray of the system.

By use of one tray, for example, up to a dozen two-ounce standard acrylic paint bottles may be stored and carried. By using one additional tray, more bottles (e.g. 18 more) may be secured into the assembled apparatus. By using the base tray and two intermediate trays yet a larger number (e.g. 48) of bottles may be easily releasably and safely stored in the assembled system.

The invention, together with further advantages and features thereof, may best be understood by reference to the following description taken in connection with the accompanying drawings, in the several figures of which, like reference numerals identify like elements.

DETAILED DESCRIPTION OF PREFERRED EMBODIMENT

Figure 1:
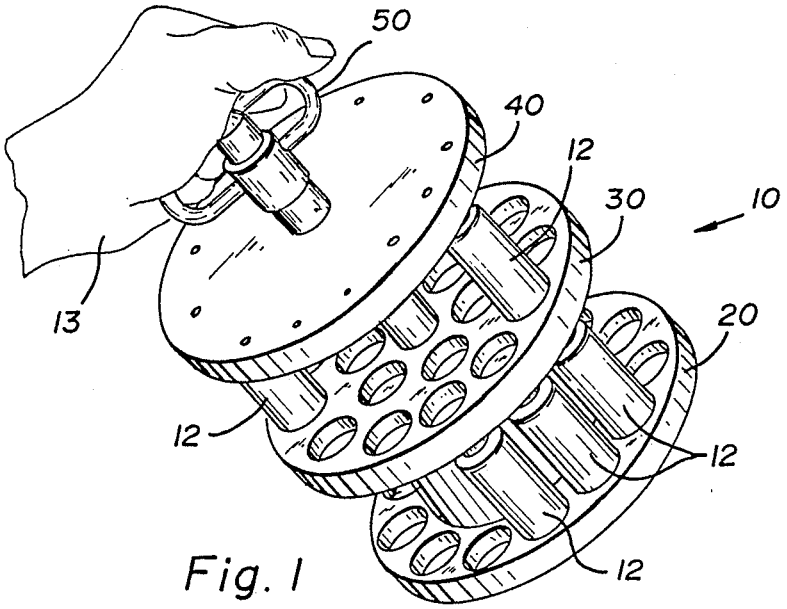
FIG. 1 is a perspective view of an artist's paint carrier system constructed in accordance with the principles of the present invention. The carrier is shown in its assembled or carrying and storage arrangement with paint bottles held therein while being carried by a hand grasping the handle of the carrier.

Referring to the figures and especially to FIG. 1, there is depicted an artist's paint carrier constructed in accordance with the principles of the present invention and generally designated by the number 10.

The carrier 10 serves to hold up to thirty standard sized acrylic paint bottles or containers 12. These bottles 12 are made of flexible plastic and are cylindrically shaped with an approximately flat (when closed) top and approximately flat bottom. The current commercial standard acrylic paint bottle is approximately three and one-half ($3\frac{1}{2}$) inches tall (with its top closed) and about one and one-quarter ($1\frac{1}{4}$) inches in diameter at its bottom.

Figure 2:
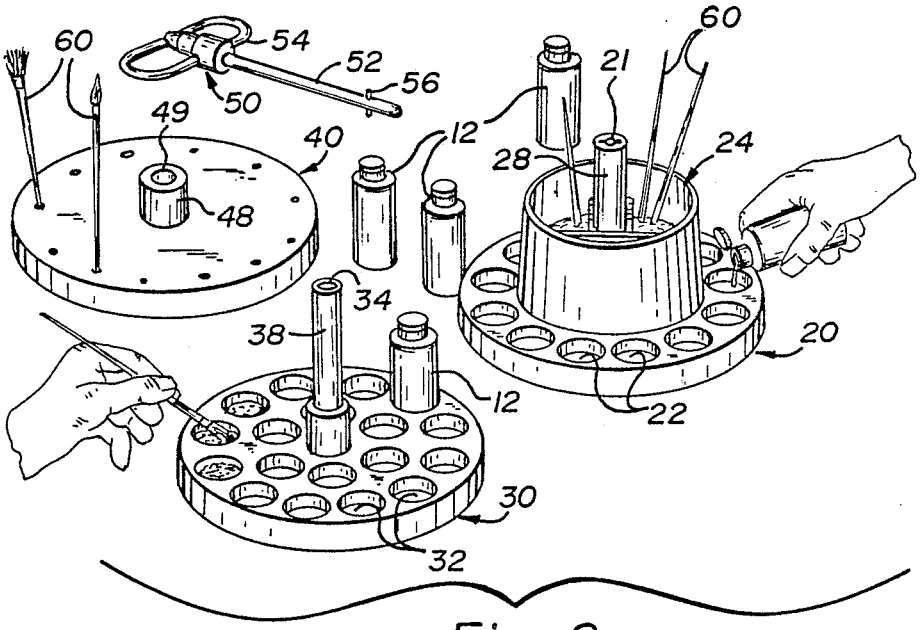
FIG. 2 is a perspective view of the system of FIG. 1 in its disassembled configuration with paint bottles and brushes and being used by a person whose hands are also illustrated.

The carrier 10 comprises four components: a base tray 20, an intermediate tray 30, a top 40 and a handle 50. As shown in FIG. 1, the assembled carrier 10 can be picked up by one hand 13 to safely carry a number of bottles 12 without dropping or spilling any of the bottles 12 even when held at an angle. As shown in FIG. 2, the components of the carrier system 10 are designed to be selectively detachable and the generally disc-shaped trays 20, 30 and top 40 may lay flat on a table or other convenient surface.

The handle 50 includes a grasp portion 54, a rod 52 which is affixed to the grasp portion 54 and a pair of locking bars 56 which project at right angles on either side of the rod 52 near its end. The trays 20 and 30 are provided with an array of identically sized and shaped shallow wells or depressions 22 and 32 which are sized to receive the bottom of the standard bottle 12 in a loose fit. That is, the bottles 12 may be easily removed from and placed into any of the depressions 22 or 32 of either tray 20 or tray 30. As illustrated in FIG. 2, the depressions 22, 32 may also be used as a palette. That is, they can serve as paint mixing wells and to this end have a pure white colored upper surface. Since the trays 20 and 30 are preferably made uniformly of molded plastic, the entire trays 20 and 30 are preferably white in color.

The base unit 20 also includes a water basin 24 for holding water and cleaning paint brushes such as the brushes 60. In addition, the base 20 defines a central pillar or post 28 which serves to receive and support the tray 30 when the carrier 10 is assembled, as in FIG. 1. The tray 30 includes a similar post 38 which may receive and support the top 40 (or as detailed below, a second tray 30).

The top 40 is sized and shaped to overlay the tray 20 or 30 and includes a number of holes 42 sized to receive and support brushes 60 of different sizes. It also features a short central post 48 which has a central opening 49. The posts 38 and 28 of trays 30 and 20 also have such openings (designated respectively 39 and 29), all of which are aligned with one another in the assembled carrier 10 and receive the rod section 52 of the handle 50.

Figure 3:
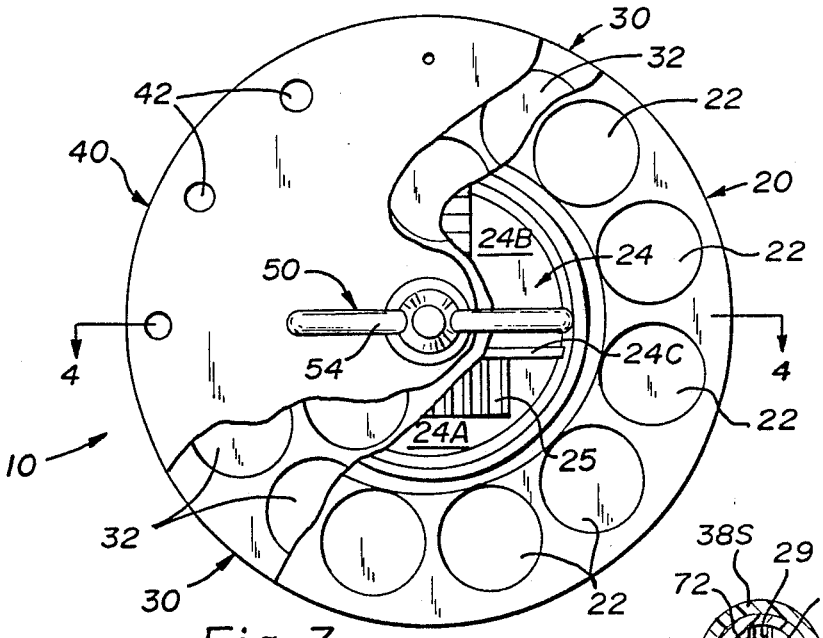
FIG. 3 is a top view of the system of FIGS. 1 and 2 in its assembled configuration with parts broken away to show hidden parts.

The water basin 24 of the base 20, as best shown in FIG. 3, includes two sections 24A and 24B divided by a wall 24C. The section 24A includes a rack 25 for aiding in cleaning brushes. The section 24B is further divided into two parts by a multi-angled wall section 26 (FIG. 2) which provides racks for aiding in the cleaning of brushes. The internal construction of the basin 24 except for the post 28 may be entirely conventional and thus need not be detailed here. As mentioned before, the tray 20 is provided with a central post or pillar 28 which rises out of the basin 24. This post 28 serves to accept either the top 40 (FIG. 6) or the second tier or layer tray 30, as shown in FIG. 1. This post 28 also serves, as will be explained below, in cooperation with different handles to releasably secure the top and intermediate layers together, as shown in either FIG. 1, FIG. 6, or FIG. 7.

Figure 4:
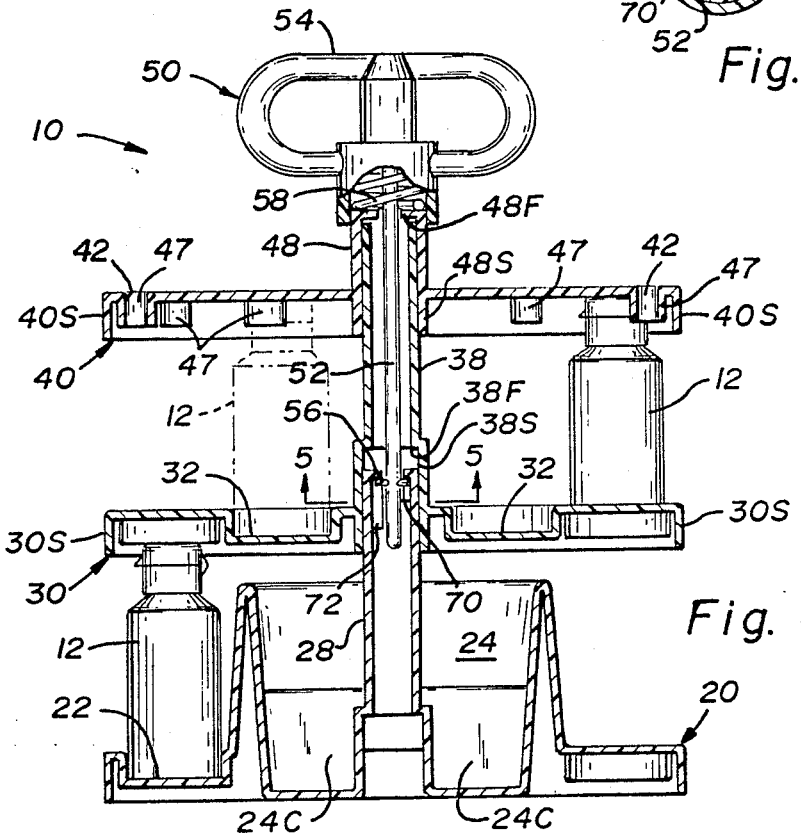
FIG. 4 is a sectional view of the carrier system of FIGS. 1–3 in its storage configuration taken along the line 4—4 of FIG. 3 and looking in the direction of the arrows associated with that line.

Each of the top 40 or intermediate layer trays 30 has a cylindrical socket or sleeve which fits atop and about the top of the post as best shown in FIG. 4. That is, as best shown in that figure, the post 28 fits within the sleeve 38S. Similarly, the top of the post 38 fits within a sleeve 48S found within the post 48. The sleeve 48 is preferably sized to loosely receive the post 38 (or 28) so that the post travels up to and supports internal flange 48F about the opening 49. The top 40 may rotate on the post 38.

The intermediate level tray 30 and the top 40, when atop the post 28, each have a bottom surface which is just above the closed tops of the bottles 12 which are positioned in the wells 22. This arrangement prevents the bottles from tipping over or falling out of the assembled carrier 10.

Figure 8:
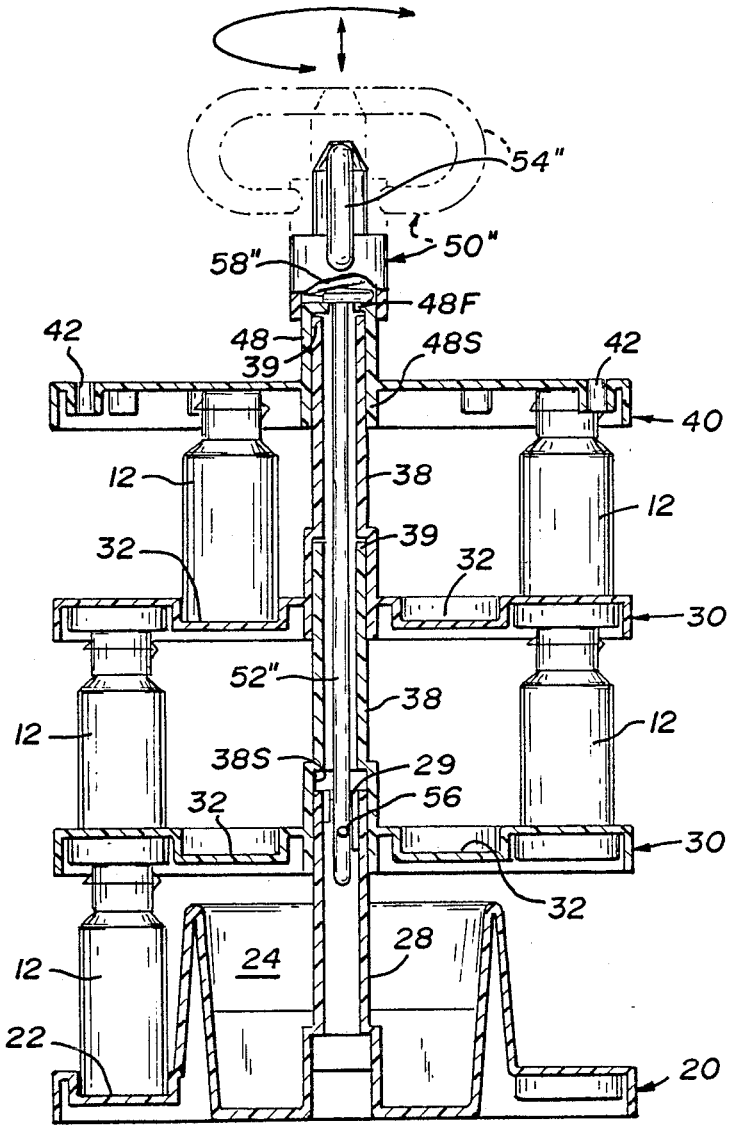
FIG. 8 is a vertical sectional view similar to that of FIG. 4, of the three tray system of FIG. 7.

The intercoupling of the layers 20 and 30, top 40 and handle 50 when in the assembled or storage position of FIG. 1 may be better appreciated by referring to the sectional views of FIGS. 4 and 8. As can be seen from these figures, the generally cylindrical shaped posts 28 and 38 are received into sleeves 38S and 48S respectively of the tray 30 and the top 40. Also, the posts 28, 38 and 48 are hollow and have the openings 29, 39 and 49 aligned for receiving the rod 52 which passes down through the sleeves and posts.

The latching bars 56 of the rod 52 are, in the assembled carrier 10, held under an internal flange positioned at the top of the post 28. A compression spring 58 in the handle 50 presses on the top of the post 48 and serves to pull the rod 52 and thus the bars 56, post 28 and base 20 upward while pushing the top 40 and tray 30 downward, to hold the assembly 10 together.

Figure 5:
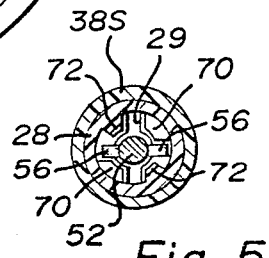
FIG. 5 is a sectional view taken from the line 5—5 of FIG. 4, looking upward in the direction of the arrows in that figure.

With the base 20 on a solid surface, the grasp portion 54 of the handle 50 can be pushed downward to compress the spring 58 further. Each of the horizontal bars 56 are, when the carrier 10 is assembled, seated in a vertical groove or valley between two ridges, a short ridge 70 and longer ridge 72, as shown in FIG. 5. The pair of ridges 70, 72 project within the interior of the post 28 and are formed unitarily therewith. Each ridge 70, 72 extends from the bottom of the top interior surface of the post and flank the slots of the opening 29 in that surface. The short ridges 70 each extend downward to a height just above the maximum downward travel of the rod allowed by the spring 58 for the assembly of FIGS. 4 or 8. The length of the ridges 72 is longer than that length of travel and thus the ridges 72 prevent the rod 52 from rotating much in a clockwise direction (as best seen in FIG. 5).

Thus, by pressing down on the grasp portion 54, the bar 56 can be advanced down to below the bottom of the ridges 70 and by rotating the grasp moved into the channels 75 (FIG. 5) aligned with the slots of the opening 21 in the top of the post 28. The handle may then be withdrawn entirely out of the posts 28, 38 and 48 and then the top 40 and the tray 30 lifted off of the assembly.

It should be noted from FIGS. 4 and 8 that the top 40 has a depending skirt 40S and that the intermediate tray 30 also has a similar depending skirt 30S. The skirts 30S and 40S serve to provide structural rigidity to the cantilevered structures and to aid in preventing the outermost portions of the top 40 and the layer 30 from flexing too much and also to stop bottles 12 from inadvertently exiting assembled the carrier 10 or 10′ or 10″.

As can also be appreciated from FIGS. 4 and 8, the brush holding holes 42 in the top 40 open into sleeve extensions 47 formed unitarily with and projecting from the bottom surface of the top member 40. These sleeves 47 are arranged in a spaced apart pattern along the circumference of the top 40 such that they may project into the gaps between bottles 12 which are in the depressions 32 or 22 of the trays 30 or 20. Thus, the sleeves 47 can fit between the bottles 12 carried by the tray below the top 40 and also serve as a back-stop to prevent tipping of those bottles 12. The sleeves 47 also structurally reinforce the structure of the top 40.

It should also be understood from FIGS. 4 and 8 that the fit between the inside of the sleeve 39 and the post 28 is a tight fit. The sleeve 38S tapers so as to decrease slightly in diameter in the upward direction and the post 28 tapers so as to decrease slightly in diameter in the upward direction so that post 28 initially easily enters the sleeve 39 but "locks up" before it reaches a break or inward projecting flange 38F in the inner wall of the sleeve 39. The post 28 is slightly larger in diameter than the post 38 such that the post 38 will travel. The purpose of this break or flange 38F is to receive and contact the smaller diameter posts 38 and allow the tray 30 to rotate on the post 38 (FIG. 8).

The sleeve 49 of the top 40 fits loosely on the post 38 and may turn easily so as to allow easy alignment of the sleeves 47 between bottles 12 that may be positioned on the tray below.

Figure 6:
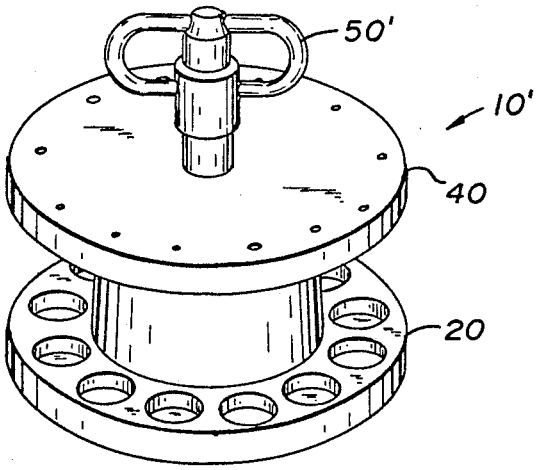
FIG. 6 is a perspective view of the carrier system of the present invention in a single tray storage and carrying configuration.
Figure 7:
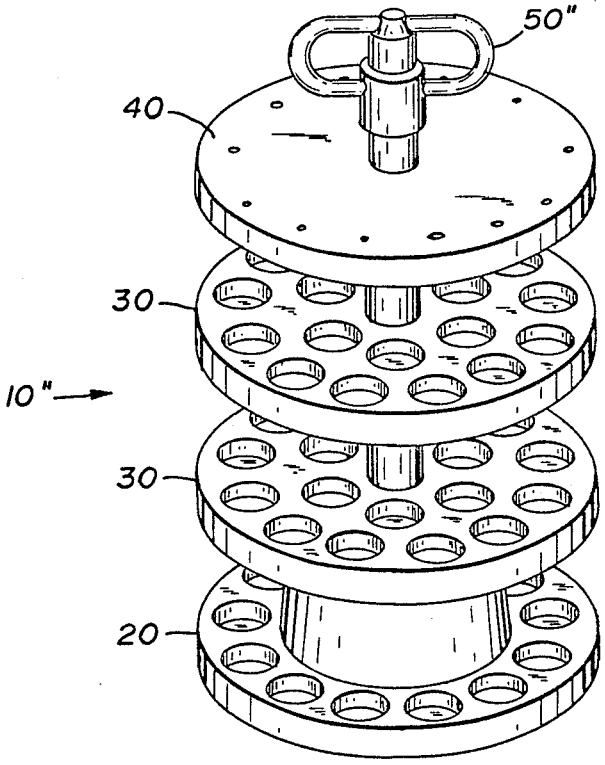
FIG. 7 is a perspective view of the carrier system of the present invention in a three tray configuration.

The present invention is versatile and adaptable. With reference to FIGS. 6 and 7 there are depicted a single layer system 10′ and three layer system 10″. These differ from the two-layer system only in the number of layers and the length of the rod 56 of the handles 50. In the system of FIG. 6 the top 40 has its sleeve 39 (FIG. 4) seated atop the post 28 of the base 20. The fit of this sleeve into this post is such that the top wall 49W (FIG. 4) is seated on the upper surface of the post 28. This places the bottom surface of the top 40 at the same height above the base 20 as was the bottom surface of the depression 32 of the tray 30 in the FIG. 4 arrangement.

The three layer system 10″ has one additional intermediate tray 30 which is identical to the prior tray 30 and the other tray 30. This is shown best in FIG. 8. The two trays 30 nest together such that the upper surface of the post 38 of one fits against the wall 37 of the upper tray 30. This arrangement makes the clearance from the effective bottom surface (the bottom of the depressions 32) of the upper tray 30 the same as that between the base 20 and the effective bottom surface of the lower tray 30. That is, the distance between the effective bottom surface of any of the top 40, trays 30 and the upper surface of the tray below it is the same and is such as to effectively "sandwich" the bottles 12 in place.

The moved position of the handle 50′ is also depicted in FIG. 8. By pushing down the handle grasp portion 54 and turning it counterclockwise the rod bars 56 are moved out of the position shown in FIGS. 4 and 5 and to a position wherein they can be removed. Turning the handle grasp section 54 clockwise from the position shown in FIG. 8 (while maintaining it depressed) aligns the rods into the grooves (FIG. 5) and by releasing the downward pressure on grasp section 54 would cause the springs to raise the rod and engage the bars 56 against the post 28.

The strength of the spring 58 is such as to securely hold the rod in place and keep the top 40 from rising up sufficiently to release any of the bottles 12 during normal handling. However, the strength of the spring 58 is not so strong as to prevent unlatching by a user who need only press the rod handle downward by simply leaning some of his or her weight on the grasp section 54 and turning the grasp section 54 ninety degrees.

In a working prototype, a spring which required force of approximately seven pounds was successfully employed. Since a fully loaded prototype carrier would weigh a total of less than five pounds, this strength provides a fair margin of safety even if the carrier should be turned over and inadvertently placed upside down on a surface. Yet, it is low enough so that any user could compress the spring and unlatch the carrier 10.

The major components, trays 20 and 30 and top 40, are made of an injection-molded plastic, preferably nylon. A prototype carrier system was constructed for use with two (2) ounce paint bottles which had an overall diameter of approximately eight and three-eighths inches. Each skirt, including that of the base, was approximately five-eighths of an inch high. The base 20 and the tray 30 each had an overall height of approximately four and seven-eighths inches. The top 40 had a height of one and five-eighths inches. The wall thickness of all three parts was for the most part a uniform one-sixteenth of an inch with the walls of the sleeve and post members being increased to approximately three thirty-seconds of an inch. The openings atop the posts 38 and 48 were round with a diameter of about one-half of an inch, that of the post 28 and a maximum opening between the ends of the slots of one-half of an inch. The width of the slots was approximately one-eighth of an inch with the central round opening being about one-quarter of an inch across.

The outside diameter of the tapering post 28 terminated at slightly over three-quarters of an inch at the top while the inside diameter of the sleeve 39 at its opening is slightly larger. The outside diameter of the post 38 was slightly less than that of the post 28. The diameter of the top of the post 48 was approximately one inch with the sleeve 47 having an opening diameter to easily receive the post 38 and to also receive in a tighter fit the post 28.

It now should be apparent that a new and improved carrier for standard sized paint containers and more has been disclosed which has advantages over prior carriers. One advantage is the lightweight carrier that this disclosure provides. By using a series of central post and sleeves as the primary vertical structure and cantilevered construction to the trays from that central pillar, a minimum of material and weight is needed.

Figure 9:
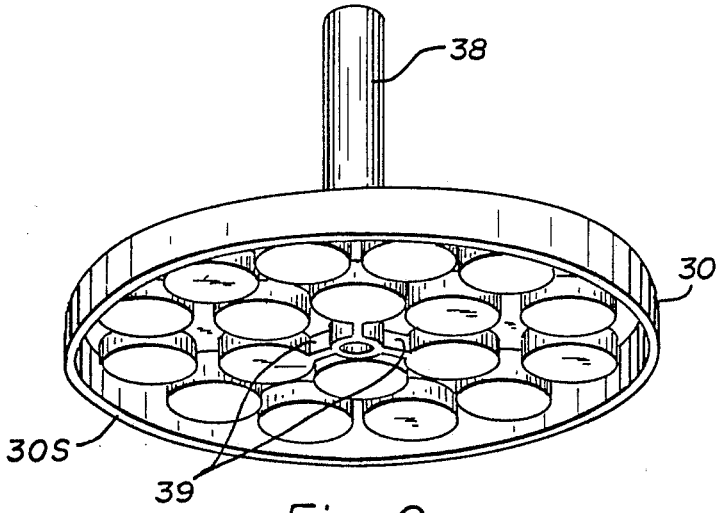
FIG. 9 is a perspective bottom view of one of the trays of the system of FIGS. 1–5 and 7–8.

Further, the corrugated or honeycomb sheet structure for forming the depressions 22, 32 greatly increase the rigidity and stiffness of the tray members, especially that of the intermediate trays 30. Note that the depressions formed in this manner serve three distinct functions: means for holding the base of the bottles 12; a paint mixing or palette function (FIG. 2); and, as shown best in the bottom view of the tray 30 of FIG. 9, a honeycomb structural reinforcement function. That is, the uniform distribution of the depressions allow the trays 20 and 30 to be constructed of thin wall plastic rather than a more massive construction that might otherwise be required to provide the needed rigidity to the cantilevered supported body of the trays 20 and especially the trays 30.

Figure 10:
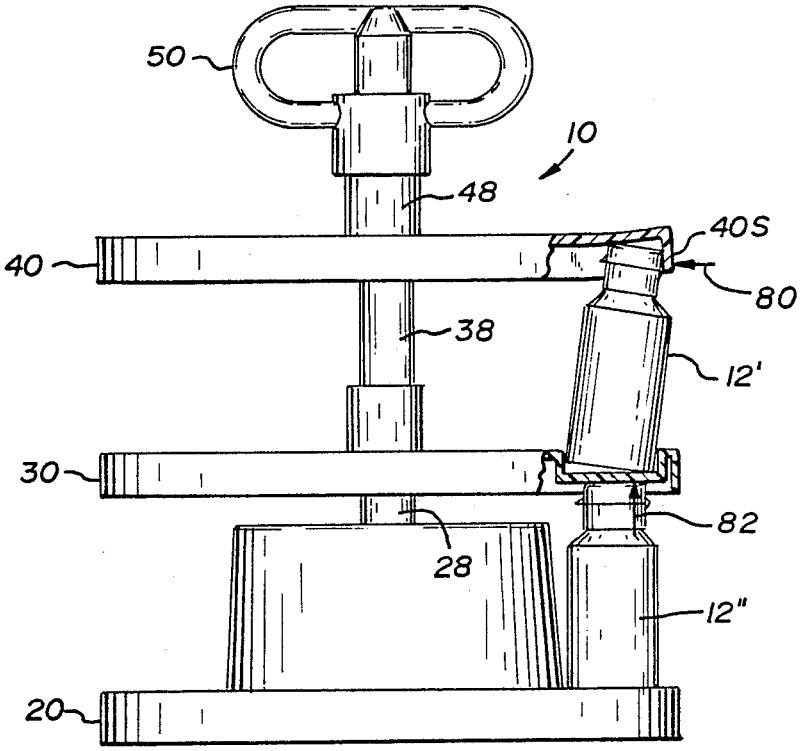
FIG. 10 is a partial view, partly broken away, of the system of FIGS. 1–5 illustrating parts moved under stress.

Similarly, the brush mounting tubular sleeves 47 of the top 40 also serve two functions: to receive hand-held brushes; and also to provide structural rigidity at the outer margins of the cantilevered structure of the top 40. Note also that the skirt 40S depends a greater distance below the effective bottom bottle-holding surface of the top 40 so as to hold the bottles 12 against sideways forces. This is illustrated in FIG. 10. The carrier 10 being made primarily of plastic will bend somewhat without breaking under stress. However, even when this occurs, as shown in FIG. 10 with a bottle 12′ being thrust outward, the skirt 40S will tend to hold the bottle 12′ in place (arrow 80).

Note also from FIG. 10 that the carrier employs the cylindrical bottles 12, when present, to increase the strength and rigidity of the carrier. Thus, the bottle 12″ in FIG. 10 serves to stop downward bending of the tray 30 and brace it (arrow 82). Thus, the more bottles one places in the carrier 10, the more its structural strength and rigidity are increased. (While the bottles 12 are constructed of plastic and are "squeezeable," their cylindrical shape does provide considerable structural strength along their vertical axis.)

It now should be apparent that a versatile carrier system has been provided which adapts itself to carry more or less bottles of paint easily by being used in a one, two or three tray configuration. The structure of the trays lends itself to lightweight construction. A two tray prototype version, constructed as described above, without bottles, weighed less than one and one-quarter pounds (less than twenty ounces).

While a particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention. One modification which applicant is currently considering is the provision of a latching structure such as is provided in post 28 also in the post 38 of the intermediate tray 30. This would allow the user to use the system 10 with one, two or three trays 30 and carry, e.g., up to 18, 36 or 54 paint bottles without use of a base tray 20. Other modifications could include interchangeable rods 52 which can be released from grasp section 54, or use of a second latching structure in the bottom of a tray 20 or 30 to allow a single length rod handle 50 to be used to latch a one tray or two tray assembly. Still other changes may, of course, be made in the structure and operation of the carrier without departing from the spirit and scope of this invention.

I claim:

1. An artist's paint carrier system for carrying a plurality of paint bottles of a predetermined shape, size and height comprising:

at least one tray defining a plurality of shallow depressions sized and shaped to loosely receive the base of the paint containers or bottles;

a removable top sized and shaped to conform to said one tray and having a bottom surface and an upper side;

means for removably mounting said top above and aligned with said one tray at a displacement above said one tray wherein the bottom surface of said top is approximately that of the predetermined height of the paint bottles when the same are placed in said shallow wells or depressions of said tray;

a handle;

means for manually latching said top, said handle and said one tray in an assembled configuration with said top above and aligned with said tray and said handle at the upper side of said top such that said handle, said top and said one tray may be picked up and carried together by said handle with any paint containers in said wells or depressions of said one tray releasably captivated between said tray and said top, said means for manually latching also allowing for manual unlatching of said one tray and said top so that they can be disassembled and any paint containers or bottles captivated therein released for easy removal therefrom for use.

2. The carrier system of claim 1 wherein:

said means for removably mounting said top includes a central post on one of said one tray or said top and a conformingly shaped sleeve on the other of said one tray or said top which post and sleeve releasably mate together to support said top at a fixed height above said one tray.

3. The carrier system of claim 2 wherein:

said top and said one tray are each formed of a plastic material and are of a general disc like configuration with said sleeve and said post each being formed unitarily with one of said one tray or said top.

4. A stackable tray for receiving paint bottles of a standard size, shape and height, which paint bottles have a flat top surface for use with a top unit or another stackable tray;

means defining a generally flat upward facing surface on which is defined at least a dozen shallow well depressions, each of which is sized and shaped to receive the bottom of the standard paint bottles such that they would each extend to a certain height above said tray and bottom means for allowing said tray to rest without tipping on a flat surface, means defining a central upstanding post on which post another stackable tray or a top unit may be received, said post having means for holding a received top or stackable tray at said certain height, and each of said at least a dozen shallow well depressions having a white surface and made of a waterproof material so as to be capable of serving as a paint mixing well and the tray as a palette.

5. The tray of claim 4 which is made unitarily of plastic formed into a continuous thin-walled configuration with said depressions being arranged about the periphery of the tray in an array whereby the depressions provide a honeycomb arrangement which reinforces the periphery of the tray against vertical deflection or bending.

6. The stackable tray of claim 4 in combination with a top unit sized to cover the at least twelve wells and having a bottom surface which is supported at said certain height, when said top unit is received on said post and supported solely thereby; and means for manually and releasably securing said top unit to said tray so that the two and any paint bottles in said wells may be carried, transported and stored without any bottles falling out.

7. The combination of claim 6 wherein said means for releasably securing includes a handle with an elongated rod, a rod passageway through said top unit and pillar of said tray, said rod having a key on it and said tray defining a keyway into which said key may fit.

8. The tray of claim 7 which is made unitarily of plastic formed into a continuous thin-walled configuration with said depressions being arranged about the periphery of the tray in an array whereby the depressions provide a honeycomb arrangement which reinforces the periphery of the tray against vertical deflection or bending.

9. An artist's paint carrier system for carrying at least a dozen different bottles of paint, each of which bottles is of a standard predetermined generally cylindrical shape and size and has a predetermined height, an approximately flat top and approximately flat bottom, comprising:

a bottom tray of a generally circular configuration, which tray defines on its upper surface a plurality of shallow wells, each of which is sized to accept in a loose fit the bottom of one of the standard paint bottles, which bottles when so received have their flat tops at a fixed height, said tray also defining a waterproof basin for receiving a quantity of water, said tray including a central pillar which extends above said fixed height;

a second tray of the same general circular overall configuration and size as said bottom tray, which intermediate tray has a bottom surface which is substantially flat and which intermediate tray receives said pillar of said base tray to overlay it with its bottom surface at approximately said fixed height, said intermediate tray also having an upper surface which defines a plurality of shallow wells, each of which is sized to accept in a loose fit the bottom of one of the standard paint bottles, which bottles when so received have their flat tops at a set height, said tray defining a central pillar which rises above said set height and a central cavity extending from its bottom surface so as to receive in a loose pillar in sleeve fit said pillar of said bottom tray;

a top of the same general circular configuration of said second tray sized to overlay that and having a central sleeve opening sized to receive the upper part of said pillar of said second tray in a loose pillar in sleeve fit, said top having a bottom surface which when so receiving said pillar of said second tray is at said set height;

a handle unit comprising a grasp section and a rod extending downward therefrom, said rod having releasable latch means; and said top, and the pillars of said trays, all defining a passageway for receiving said rod of said handle and a releasable detent means for latching the handle to said bottom tray, said detent means including spring bias means for urging the handle in said latching arrangement.

* * * * *